United States Patent [19]

Aigo

[11] 4,339,297

[45] Jul. 13, 1982

[54] APPARATUS FOR ETCHING OF OXIDE FILM ON SEMICONDUCTOR WAFER

[76] Inventor: Seiichiro Aigo, 3-15-13, Negishi, Daito-ku, Tokyo, Japan

[21] Appl. No.: 254,043

[22] Filed: Apr. 14, 1981

[51] Int. Cl.[3] ..... B44C 1/22; C03C 15/00; C03C 25/06

[52] U.S. Cl. ..... 156/345; 156/639; 156/640; 269/21

[58] Field of Search ..... 156/345, 639, 640; 269/20, 21; 134/21, 23, 33, 149, 157

[56] References Cited

U.S. PATENT DOCUMENTS

| | | | |
|---|---|---|---|
| 3,489,608 | 1/1970 | Jacobs et al. | 134/25 |
| 3,536,594 | 10/1970 | Pritchard | 269/21 X |
| 3,747,282 | 7/1973 | Katzke | 269/21 X |
| 4,021,278 | 5/1977 | Hood et al. | 156/626 |
| 4,280,689 | 7/1981 | Frosch | 269/21 |

*Primary Examiner*—William A. Powell
*Attorney, Agent, or Firm*—McGlew and Tuttle

[57] ABSTRACT

An apparatus for applying photo-etching on one surface of a semiconductor wafer formed with oxide film is provided, which comprises a cup-shaped basin having at the bottom thereof a vertical passage for introducing etching liquid, and a chuck rotatably supported above said basin for vacuum-absorbing a semiconductor wafer at the bottom surface thereof, said one surface of wafer facing downward being contacted with etching liquid that is blown up vertically through said vertical passage of the basin, to thereby prevent the upward facing rear surface of wafer from being contacted with etching liquid to hold oxide film thereon, and means for rotating said chuck to remove any reaction gas resulted on said one surface of wafer.

6 Claims, 4 Drawing Figures

APPARATUS FOR ETCHING OF OXIDE FILM ON SEMICONDUCTOR WAFER

BACKGROUND OF THE INVENTION

This invention relates to an apparatus for applying photo-etching on one surface of a semiconductor wafer formed with oxide film thereon.

In manufacture of semiconductor circuits, oxide film is formed on surfaces of a semiconductor wafer made of silicon, and then photo-etching of oxide film on one surface of wafer is carried out in order to permeate diffusion material of either P-type or N-type selectively on said one surface. Therefore, photosensitive liquid (photo-hardening type photoresist) is coated in a thin film form on predetermined portions of the wafer surface, and next printed thereon and developed for forming a pattern for photo-etching of oxide film, said pattern providing a semiconductor circuit, while the other surface of wafer is not formed with any pattern so that oxide film thereon is wholly exposed.

However, in a commonly accepted technique, the oxide film etching is carried out in a carrier for etching in which a suitable number of wafers are received, and wafers in the carrier are dipped into an etching liquid in a dipping container. Accordingly, oxide film of the wafer surface under portions of the pattern of photoresist remains without any effects of etching, while oxide film of other portions of wafer surfaces, i.e., the main and rear surfaces of wafer, is removed by etching, which provides exposure of silicon on the removed portions. Then, after removal of the photoresist, the wafer is treated with diffusive permeation of P-type or N-type diffusion material within a diffusion oven of a high temperature such as 800° C.–1200° C. In the diffusion process, the rear surface of a wafer having no oxide film is permeated with diffusion material in the same way as the main surface. Such a wafer of which the rear surface is permeated with diffusion material can not be used as it stands, due to its characteristics. Therefore, it is required to delete the permeated depth portion of the rear surface by grinding or the like. Also, there is selectively remaining oxide film on the main wafer surface, but there is no oxide film on the rear wafer surface, so that the wafer suffers deflection and/or torsion due to difference in thermal expansion rate between the main and rear surfaces of wafer in the process within the diffusion oven, which may provide a serious defect on the wafer. Further, in the oxide film etching process of the dipping type, it is difficult to remove any reaction gas caused in the process, said gas being apt to contact to wafer surfaces, so that it may result in unevenness in etching reaction.

Therefore, an object of the present invention is to provide an apparatus for applying photo-etching on one surface of a semiconductor wafer, in which only one surface of a wafer is contacted with etching liquid to thereby hold oxide film of the rear surface as it stands, so as to obviate deletion of a permeated depth portion of the rear wafer surface as well as to prevent any deflection and torsion of the wafer in the diffusion process.

Another object of the invention is to provide an improved apparatus for etching of oxide film of semiconductor wafer in which the wafer surface is not contacted with any reaction gas caused in the etching process.

In attaining the described objects of the invention, an etching apparatus according to the present invention includes a cup-shaped basin having at the bottom thereof a vertical passage for introducing etching liquid, a chuck rotatably supported above said basin for vacuum-absorbing a semiconductor wafer at the bottom surface thereof and support means for supporting the wafer temporarily and horizontally before the wafer is vacuum-absorbed by the chuck. Said one surface (main surface) of a wafer is downward facing and is contacted with etching liquid that is blown vertically upward through the vertical passage of the basin, to thereby prevent the upward facing rear surface of a wafer from being contacted with etching liquid. This etching apparatus also includes means for rotating the chuck so as to remove any reaction gas resulted on the one surface of a wafer by centrifugal force.

The invention and its objects and advantages will become more apparent in the following detailed description of the preferred embodiments of the invention.

BRIEF DESCRIPTION OF THE DRAWING

In the detailed description of the preferred embodiments presented below, reference is made to the accompanying drawing in which.

DESCRIPTION OF THE PREFERRED EMBODIMENTS

Figure 1:
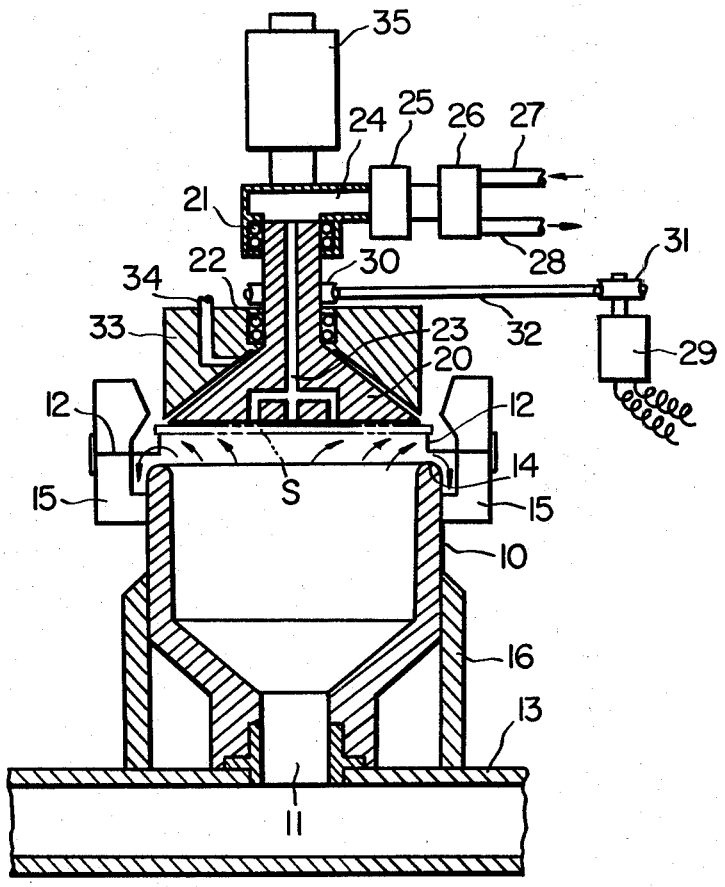
FIG. 1 is a vertical sectional view of an apparatus for etching of oxide film of semiconductor wafer embodied by the present invention.
Figure 2:
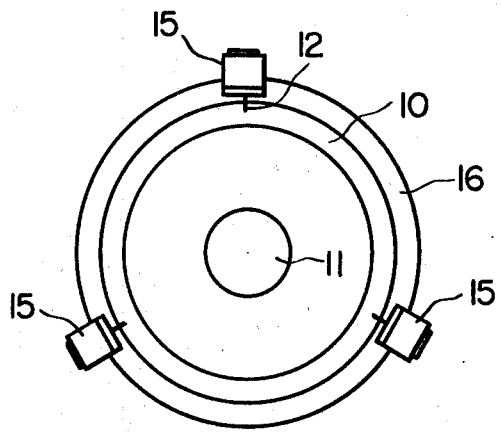
FIG. 2 is a plan view of a cup-shaped basin contained in an etching apparatus.

Referring now to FIGS. 1 and 2, an etching apparatus according to the present invention basically includes a cup-shaped basin 10 having at the bottom thereof a vertical passage 11 for introducing etching liquid, means for supporting a semiconductor wafer temporarily and horizontally, preferably near above the top periphery of the basin 10, for example as shown, said means being consisted of at least three pins 12 with an upward oriented tip mounted on or near the top periphery of the basin, and a chuck 20 rotatably supported above the basin 10 and adapted to absorb a semiconductor wafer by vacuum, and furthermore means for rotating the chuck 20. The passage 11 at the bottom of the basin is connected at the lowermost portion thereof with a conduit 13 of etching liquid feed line. The top portion 14 of basin 10 is circular as shown in FIG. 2 and is preferably of a curved convex cross-sectional form such as an arc-shaped section. Normally, the inner periphery of basin 10 is of a smaller diameter than that of a semiconductor wafer to be set thereabove. In the embodiment shown in the Figures, the top outer periphery of the basin has secured thereto at least three support members 15. The respective support members have a pin 12 mounted thereon. Otherwise, these pins 12 will be secured directly in the top periphery of basin 10. Also, these pins 12 serve to support temporarily and horizontally a semiconductor wafer S to be vacuum-absorbed to the chuck 20, while as means for supporting a wafer temporarily and horizontally, the pins 12 are not always needed, and any other arrangement may be used therefor. Further, means for supporting a wafer temporarily and horizontally may be disposed outside the basin 10, wherein chuck 20 picks up a wafer supported on the means and brings to just above the basin 10. 16 denotes a cylindrical guide for etching liquid flown out over basin 10. This guide 16 surrounds the lower portion of basin 10.

Chuck 20 is rotatably supported vertically by means of a pair of bearings 21 and 22, and has a passage 23 along its axis. The passage 23 is communicated at the top thereof with a vacuum pipe 24. Also, an area of bottom surface of chuck 20 is communicated with the central passage 23. In this arrangement, there are disposed a pressure sensor 25 and a valve 26 at positions of pipe 24. Connected with the valve 26 are both a pipe 27 for introducing an inert gas such as nitrogen gas and a pipe 28 communicated with a vacuum device (not shown). Provided at upper portion of chuck 20 is means for rotating the chuck, which is preferably a belt transmission device composed of an electric motor 29, a pulley 30 on the chuck, a pulley 31 on the electric motor and a belt 32 disposed between the pulleys, as shown in FIG. 1. Otherwise, this rotating means may be consisted of any other arrangement, such as a gear train. Preferably, the chuck 20 has a body of substantially frustum shape and a holder 33 surrounding the chuck body with a gap therebetween. Holder 33 is provided with a port 34 used for gas introduction. Also, in an aspect of the invention, there is provided a device for slightly lifting the chuck 20. This lifting device preferably consists of a pneumatic cylinder 35. These members such as basin 10, chuck 20 and other relevant parts may be made of polypropylene.

In operation, a semiconductor wafer S formed with a photo-etching pattern applied on oxide film of the main surface of a wafer is positioned on pins 12 with its main surface facing downward. Then, chuck 20 is lowered to the positioned wafer. At first, by operation of valve 26, nitrogen gas flows from pipe 27 and through passage 23, and thus blows out from the bottom surface of chuck 20. When chuck 20 is lowered to the wafer S, blowing resistance of nitrogen gas is increased. Then, pressure sensor 25 senses the increase of blowing resistance and thereby switches the valve 26 to communicate the passage 23 with vacuum pipe 28. Thus, the bottom surface of chuck 20 communicates with the vaccum pipe 28 and absorbs the wafer S by vacuum. Thereafter, pneumatic cylinder 35 lifts the chuck 20 with wafer S slightly. When wafer S is held on the bottom surface of chuck 20, etching liquid is introduced from conduit 13 into basin 10 through passage 11, blowing up against the downward facing surface of the held wafer. Then, etching liquid flows outwards along the wafer surface and over the top periphery of basin 10, flowing down along outer peripheral surface of basin and along other peripheral surface of guide 16. In this case, the curved convex form of the top peripheral portion 14 of basin 10 as shown enables etching liquid to flow over the top periphery of basin smoothly in laminar or similarly laminar stream condition by surface tension thereof. This prevents etching liquid from turning up to the upward facing rear surface of wafer. If desired, an inert gas such as nitrogen gas may be fed into port 34 of holder 33, said gas passing through the gap defined between chuck 20 and holder 33 and flowing out from outer periphery of the wafer upper surface, to thereby prevent more effectively etching liquid from turning up to the wafer surface.

As mentioned above, photo-etching on the main surface of a wafer is carried out by means that etching liquid is blown up against the downward facing main surface of wafer held above the basin 10. Any reaction gas caused in the etching process is almost flown out with the stream of etching liquid. Furthermore, if needed, electric motor 29 will be energized to rotate the chuck 20, so as to remove any reaction gas contacting to the main surface of wafer by centrifugal force, so that no reaction gas may contact to the wafer surface. As for etching liquid, fluoric acid liquid, nitric acid liquid or phosphoric acid liquid will be normally used. As phosphoric acid liquid is of comparatively high viscosity, reaction gas is apt to contact to the wafer surface. In such a case, rotation of chuck 20 will be effective for removal of reaction gas.

Figure 3:
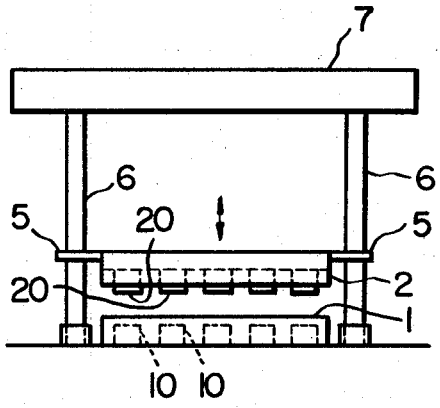
FIG. 3 is a front elevational view showing a system including a plurality of the etching apparatus.
Figure 4:
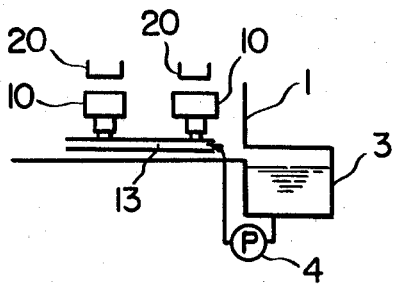
FIG. 4 is a partial schematic view of the system shown in FIG. 3.

Also, although this etching apparatus will be used as one unit, a plurality of such apparatus as a set will be advantageously used for applying photo-etching at a time on a plurality of semiconductor wafers. FIGS. 3 and 4 illustrate such a system for simultaneous etching of wafers. In this shown system, a plurality of basins 10 are disposed in a container 1 on the same level, and the same number of chucks 20 and relevant members are secured to a movable cover 2 in position corresponding to the respective basins 10. Conduit 13 may be used as a common line for at least several basins 10. This cover 2 is guided vertically by means of opposed, laterally extending flanged portions 5 thereof, openings being formed in the respective flanged portions 5 for movably engaging respective guide bars 6. These guide bars 6 are secured between a base and ceiling 7. This system including the apparatus, as shown in FIG. 4, has a tank 3 for etching liquid and a pump 4 outside the container 1. Pump 4 serves to feed etching liquid in tank 3 to the common conduit 13.

As apparent in the above description, according to the apparatus embodied by the present invention, photo-etching is applied on one surface of a semiconductor wafer, and the upward facing rear surface of a wafer is not contacted with etching liquid to thereby hold oxide film thereon as it stands. Therefore, in the next diffusion process, the rear surface of wafer is not permeated with diffusion material, so that it is not required to perform grinding or the like to delete any permeated depth portion thereof. And, as the wafer rear surface has oxide film thereon, any deflection or torsion in the wafer is not caused in the diffusion process. Further, because any reaction gas contacting to the downward facing wafer surface will be removed by centrifugal force due to rotation of chuck, effective photo-etching can be performed without any unevenness of etching reaction.

The present invention may be embodied in other forms or carried out in other ways without departing from the spirit or essential characteristics thereof. The present embodiments are therefore to be considered as in all respects illustrative and not restrictive, the scope of the invention being indicated by the appended claims, and all changes which come within the meaning and range of equivalency are intended to be embraced therein.

I claim:

1. An apparatus for applying photo-etching on one surface of a semiconductor wafer formed with oxide film, which comprises;

a cup-shaped basin having at the bottom thereof a vertical passage for introducing etching liquid, a chuck rotatably supported above said basin for vacuum-absorbing a semiconductor wafer at the bottom surface thereof, support means for supporting a wafer temporarily and horizontally before the wafer is vacuum-absorbed by the chuck, said one surface of a wafer which is downward facing being contacted with etching liquid that is blown vertically upward through said vertical passage of the basin, to thereby prevent the upper surface of a wafer from being contacted with etching liquid, and means for rotating said chuck to remove any gas resulted on the one surface of a wafer.

2. An apparatus for etching of oxide film on semiconductor wafer set forth in claim 1, said rotating means comprises an electric motor and a belt transmission device connecting the motor with said chuck.

3. An apparatus for etching of oxide film on semiconductor wafer set forth in claim 1, said apparatus further comprises means for slightly lifting said chuck while said chuck supports a wafer by vacuum absorption.

4. An apparatus for etching of oxide film on semiconductor wafer set forth in claim 3, said lifting means consists of a pneumatic cylinder device.

5. An apparatus for etching of oxide film on semiconductor wafer set forth in claim 1, said chuck includes a body of substantially frustum shape, a holder surrounding said body with a gap therebetween and a gas inlet formed in the holder to introduce an inert gas into the gap, said gas flowing out from the outer periphery of the upper surface of wafer.

6. An apparatus for etching of oxide film on semiconductor wafer set forth in claim 1, said supporting means consists of three pins positioned near above the top periphery of said basin.

* * * * *